US005890037A

United States Patent [19]

Kukimoto et al.

[11] Patent Number: 5,890,037

[45] Date of Patent: Mar. 30, 1999

[54] ELECTROPHOTOGRAPHIC APPARATUS USING PHOTOCONDUCTIVE MEMBER CHARGEABLE WITH MAGNETIC BRUSH

[75] Inventors: Tsutomu Kukimoto, Yokohama; Akio Maruyama, Tokyo; Shuichi Aita, Yokohama; Yoshifumi Hano, Inagi, all of Japan

[73] Assignee: Canon Kabushiki Kaisha, Tokyo, Japan

[21] Appl. No.: 491,703

[22] Filed: Jun. 19, 1995

[30] Foreign Application Priority Data

| | | | |
|---|---|---|---|
| Jun. 22, 1994 | [JP] | Japan | 6-140202 |
| Jun. 22, 1994 | [JP] | Japan | 6-140203 |
| Jun. 22, 1994 | [JP] | Japan | 6-140209 |

[51] Int. Cl.[6] ..... G03G 15/02

[52] U.S. Cl. ..... 399/175

[58] Field of Search ..... 355/200, 211, 355/212, 219; 399/159, 175, 174, 176; 361/225; 430/35

[56] References Cited

U.S. PATENT DOCUMENTS

| | | | |
|---|---|---|---|
| 4,269,920 | 5/1981 | Wada et al. | 430/107 |
| 4,371,257 | 2/1983 | Nishikawa . | |
| 4,851,960 | 7/1989 | Nakamura et al. | 361/225 |
| 5,159,389 | 10/1992 | Minami et al. . | |
| 5,351,109 | 9/1994 | Haneda | 355/219 |
| 5,352,552 | 10/1994 | Maruyama et al. | 430/18 |
| 5,357,323 | 10/1994 | Haneda et al. | 355/219 |
| 5,385,797 | 1/1995 | Nagahara et al. | 430/67 |
| 5,391,446 | 2/1995 | Ohtani et al. | 430/58 |
| 5,391,449 | 2/1995 | Maruyama et al. | 430/66 |
| 5,406,353 | 4/1995 | Asanae | 355/200 |
| 5,422,210 | 6/1995 | Maruyama et al. | 430/59 |
| 5,432,033 | 7/1995 | Asanae et al. | 355/219 X |

FOREIGN PATENT DOCUMENTS

| | | |
|---|---|---|
| 0474220 | 3/1992 | European Pat. Off. . |
| 0593245 | 4/1994 | European Pat. Off. . |
| 57-084460 | 5/1982 | Japan . |
| 61-57958 | 3/1986 | Japan . |
| 63-030850 | 2/1988 | Japan . |
| 63-149669 | 6/1988 | Japan . |
| 03010267 | 1/1991 | Japan . |
| 2074745 | 11/1981 | United Kingdom . |

OTHER PUBLICATIONS

Patent Abstract of Japan, vol. 12, No. 468 (P–797) [3315] Dec. 8, 1988 (JP#63–187267; abstract).

Tetsutani, et al, "New Photoreceptor charging method . . . " J. Appl. Phys. 62 (7) Oct. 1987 pp. 2665–2668.

*Primary Examiner*—Robert Beatty

*Attorney, Agent, or Firm*—Fitzpatrick, Cella, Harper & Scinto

[57] ABSTRACT

An electrophotographic apparatus is constituted by an electrophotographic photosensitive member, and a charger, imagewise exposing light and a developer disposed in this order opposite to the photosensitive member. The photosensitive member has a surface layer which is a charge-injection layer. The charger includes a charging member formed of magnetic particles and disposed contactable to the photosensitive member so as to charge the photosensitive member to at least 80% of a DC voltage supplied to the charging member. The magnetic particles have a volume resistivity in the range of $1\times10^4$–$1\times10^9$ ohm.cm, and the magnetic particles have a surface layer having a volume resistivity of at most $1\times10^9$ ohm.cm.

36 Claims, 2 Drawing Sheets

ELECTROPHOTOGRAPHIC APPARATUS USING PHOTOCONDUCTIVE MEMBER CHARGEABLE WITH MAGNETIC BRUSH

FIELD OF THE INVENTION AND RELATED ART

The present invention relates to an electrophotographic apparatus, a process cartridge and an image forming method respectively using a magnetic brush for charging an electrophotographic photosensitive member.

Hitherto, a large number of electrophotographic processes have been known. In these processes, an electrostatic latent image is formed on a photosensitive member comprising a photoconductive material by charging means and imagewise exposure means, then the latent image is developed and visualized with a toner, and the resultant toner image is, after being transferred onto a transfer-receiving material, such as paper, as desired, fixed by heating, pressing, heating and pressing, etc., to obtain a copy or a print. The residual toner remaining on the photosensitive member without being transferred is removed in a cleaning steps. The above steps are repeated.

In recent years, various organic photoconductive substances have been developed as a photoconductive substance for electrophotographic photosensitive member, and accordingly a function separation-type photosensitive member including a lamination of a charge generation layer and a charge transport layer is commercialized and loaded on copying apparatus, printers, facsimile apparatus, etc. In such electrophotographic apparatus, corona discharge means have been conventionally used as charging means, but are accompanied with difficulties, such as occurrence of a large amount of ozone and a filter for removing the ozone, resulting in a size enlargement and an increase in running cost of the apparatus.

As a technical solution of such difficulties, a charging method for minimizing the occurrence of ozone has been developed, wherein a charging means, such as a roller on a blade is abutted to the photosensitive member surface to form a narrow gap in the proximity of the contact portion where a discharge occurs, which appears to follow Paschen's law. Among these, it is preferred to use a roller charging system using a charging roller as a charging means in view of the charging stability.

The charging is effected by discharge from the charging member to a charge-receiving member, so that the charging is started by application of a voltage exceeding a certain threshold. For example, in case of abutting a charging roller against a photosensitive member having a ca. 25 $\mu$m-thick photosensitive layer comprising an organic photoconductor, the surface potential of the photosensitive member is increased by application of a voltage of ca. 640 volts or above and thereafter increased linearly proportional to an applied electric field at a slope of 1. Hereinafter, the threshold voltage is defined as a charge initiation voltage Vth. In other words, in order to obtain a surface potential Vd on the photosensitive member, a larger DC voltage of Vd+Vth has to be applied to the charging roller. Further, the resistivity of the charging roller can vary corresponding to a change in environmental conditions, so that it has been difficult to control the potential of the photosensitive member at a desired value.

For this reason, in order to accomplish a further uniform charging, it has been proposed to use a DC+AC charging system of applying to a charging roller a voltage obtained by superposing an AC voltage having a peak-to-peak voltage of at least 2×Vth on a DC voltage corresponding to a desired Vd as disclosed in Japanese Laid-Open Patent Application (JP-A) 63-149669. This aims at taking advantage of a potential smoothening effect of the AC voltage, and the potential of the charge-receiving member is converged to a central value Vd of the AC voltage, which is less affected by a change in external conditions.

In the charging method (contact or proximity charging method) based on a charging mechanism utilizing a discharge from the charging member to the photosensitive member or charge-receiving member, it is still necessary to apply a charging voltage in excess of a required surface potential of the photosensitive member. Further, as a result of application of the AC electric field, new problems have occurred, such as the occurrence of vibration of the charging member and the photosensitive member and a noise accompanying the vibration (hereinafter referred to as "AC charging noise" and accelerated deterioration of the photosensitive member surface due to the discharge.

On the other hand, there is known an image forming method wherein a photosensitive member having an electroconductive protective film is charged by using electroconductive fine particles as disclosed in JP-A 61-57958. The JP reference contains a description to the effect that a photosensitive member having a semiconductive protective film having a resistivity of $10^7$–$10^{13}$ ohm.cm can be charged uniformly, without irregularities and without causing charge-injection into the photosensitive layer by using electroconductive particles having a resistivity of at most $10^{10}$ ohm.cm, whereby good image reproduction can be accomplished. According to this method, it is possible to prevent occurrence of vibration and noise which have been problems in the AC charging, but the charging efficiency is low. Further, as the transfer residual toner on the photosensitive member is scraped by the conductive particles as the charging member, the toner is attached to the charging member, whereby the charging performance is liable to be changed.

Further, it has been desired to charge a photosensitive member by direct injection of charge.

So-called injection charging method of injecting a charge to a trap level at the surface of a photosensitive member by applying a voltage to a contact charging member, such as a charging roller, a charging fiber brush, or a charging magnetic brush has been reported in, e.g., Japan Hardcopy 92 Annual Paper Collection P. 287, "Contact Charging Performance by Using Electroconductive Roller" (in Japanese). According to this method, a photosensitive member which is insulating in the dark is subjected to injection charging by a low-resistivity charging member supplied with a voltage, so that the method essentially requires that the charging member has a sufficiently low resistivity and an electroconductivity-imparting substance (such as conductive filler) is sufficiently exposed to the surface. Accordingly, the above paper describes that the charging member preferably comprises an aluminum foil or an ion-conductive charging member having a sufficiently low resistivity in a high-humidity environment. According to our study, a charging member capable of effecting a sufficient charge injection to a photosensitive member may have a resistivity of at most $1\times10^3$ ohm.cm, above which a difference begins to occur between the applied voltage and the charge potential, so that the stability of charge potential is liable to be impaired.

However, when such a charging member having a low resistivity is actually used, an excessively large leakage current is liable to flow into scars or pinholes formed at the photosensitive member surface. Several difficulties are thereby, such as insufficient charging in the neighborhood, enlargement of the pinholes and conduction breakdown of the charging member.

In order to prevent these problems, it is necessary to provide a resistivity on the order of $1\times10^4$ ohm.cm to the charging member. At this level of resistivity, however, the charge injection performance into the photosensitive member is lowered, so that effective charging cannot be performed. This is a contradiction.

Accordingly, it has been desired to solve the above-mentioned problems in a contact-type charging device or an image forming method using such a charging device. More specifically, it has been desired to satisfy in combination a good charging performance by charge injection which cannot have been accomplished without using a low-resistivity charging member and prevention of pinhole leakage on the charge-receiving member which cannot have been accomplished by using such a low-resistivity charging member.

Further, in an image forming method using a charging member contacting a charge-receiving member, the charging member is liable to be soiled (by toner melt-sticking) to cause a charging failure leading to image defects and is thus liable to cause a problem in successive image forming performance. Also in the method of directly injecting charge into a charge-receiving member, an urgent problem to be solved is allowing image formation on a large number of sheets without causing soiling of the charging member, thus causing charging failure.

SUMMARY OF THE INVENTION

An object of the present invention is to provide electrophotographic apparatus, process cartridge and image forming method, wherein good charge injection is performed, the charging member is less liable to be soiled and therefore a good charging performance can be retained over a long period.

According to the present invention, there is provided an electrophotographic apparatus, comprising: an electrophotographic photosensitive member, and charging means, imagewise exposure means and developing means disposed in this order opposite to the photosensitive member, wherein said photosensitive member has a surface layer comprising a charge-injection layer, said charging means includes a charging member comprising magnetic particles and disposed contactable to the photosensitive member so as to charge the photosensitive member based on a voltage received thereby, the magnetic particles have a volume resistivity in the range of $1\times10^4$–$1\times10^9$ ohm.cm, and the magnetic particles have a surface layer having a volume resistivity of at most $1\times10^9$ ohm.cm.

According to another aspect of the present invention, there is provided a process cartridge, comprising: an electrophotographic photosensitive member, and charging means and developing means disposed in this order opposite to the photosensitive member, wherein said photosensitive member has a surface layer comprising a charge-injection layer, said charging means includes a charging member comprising magnetic particles and disposed contactable to the photosensitive member so as to charge the photosensitive member based on a voltage received thereby, the magnetic particles have a volume resistivity in the range of $1\times10^4$–$1\times10^9$ ohm.cm, the magnetic particles have a surface layer having a volume resistivity of at most $1\times10^9$ ohm.cm, and said electrophotographic photosensitive member, charging means and developing means are integrally supported to form a cartridge which is detachably mountable to an electrophotographic apparatus main body.

According to still another aspect of the present invention, there is provided an image forming method, comprising the steps of:

charging an electrophotographic photosensitive member by applying a voltage to a charging member comprising magnetic particles and disposed in contact with the photosensitive member, imagewise exposing the charged photosensitive member to form an electrostatic image on the photosensitive member, and developing the electrostatic image, wherein said photosensitive member has a surface layer comprising a charge-injection layer, the magnetic particles have a volume resistivity in the range of $1\times10^4$–$1\times10^9$ ohm.cm, and the magnetic particles have a surface layer having a volume resistivity of at most $1\times10^9$ ohm.cm.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Figure 1:
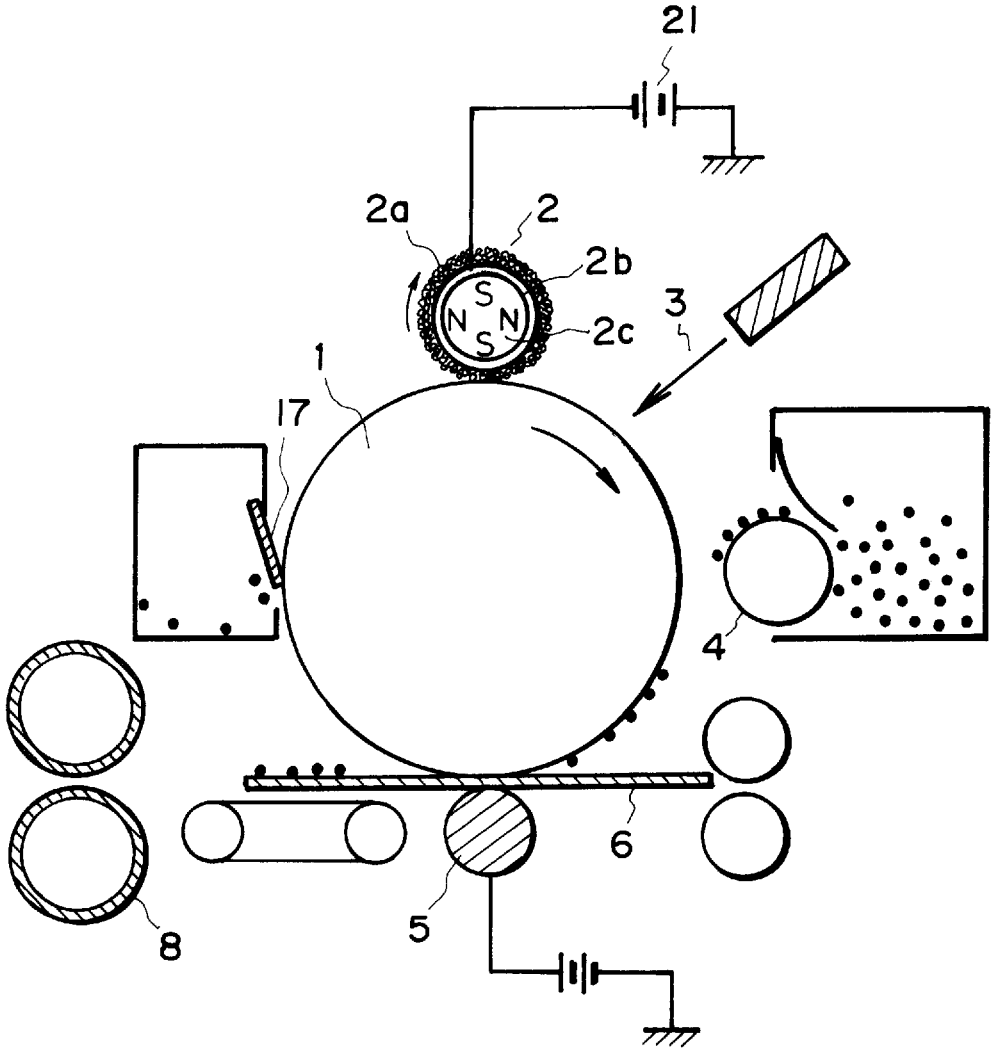
FIG. 1 is a schematic illustration of an embodiment of the image forming apparatus according to the present invention.

FIG. 1 is a schematic illustration of an embodiment of the image forming apparatus according to the present invention.

Referring to FIG. 1, an electrophotographic printer as an embodiment of the image forming apparatus includes an electrophotographic photosensitive member (photosensitive drum) rotating in the direction of an arrow, and further includes a charging member 2, imagewise exposure means 3, developing means 4, transfer means and cleaning means 17 disposed in this order opposite to the photosensitive member 1 so as to surround the photosensitive member 1.

As will be described in more detail, the photosensitive member 1 has a charge-injection layer as a surface layer.

The charging member 2 comprises magnetic particles 2*a* which are formed into magnetic brush or ears erected under the action of a magnetic field exerted by a magnet roller 2*c* enclosed within a non-magnetic sleeve 2*b* and is supplied with a voltage from a power supply 21.

The charging member 2 has to satisfy, in combination, a function of satisfactorily injecting charge into the charge injection layer of the photosensitive member 1 and a function of conduction breakdown of the charging member and the photosensitive member caused by concentration of a charging current at defects, such as pinholes formed in the photosensitive member. Accordingly, the charging member may preferably have a resistance of $1\times10^4$–$1\times10^9$ ohm, particularly $1\times10^4$–$1\times10^7$ ohm. Below $1\times10^4$ ohm, the pinhole leakage is liable to occur. Above $1\times10^9$ ohm, a satisfactory charging is liable to be hindered. In order to provide a resistance in the above-mentioned range to the charging member 2, the magnetic particles constituting the charging member should have a volume resistivity in the range of $10^4$–$1\times10^9$ ohm.cm, preferably $10^4$–$1\times10^7$ ohm.cm.

Incidentally, the volume resistivity values of magnetic particles described herein are based on valves measured in the following manner.

Figure 2:
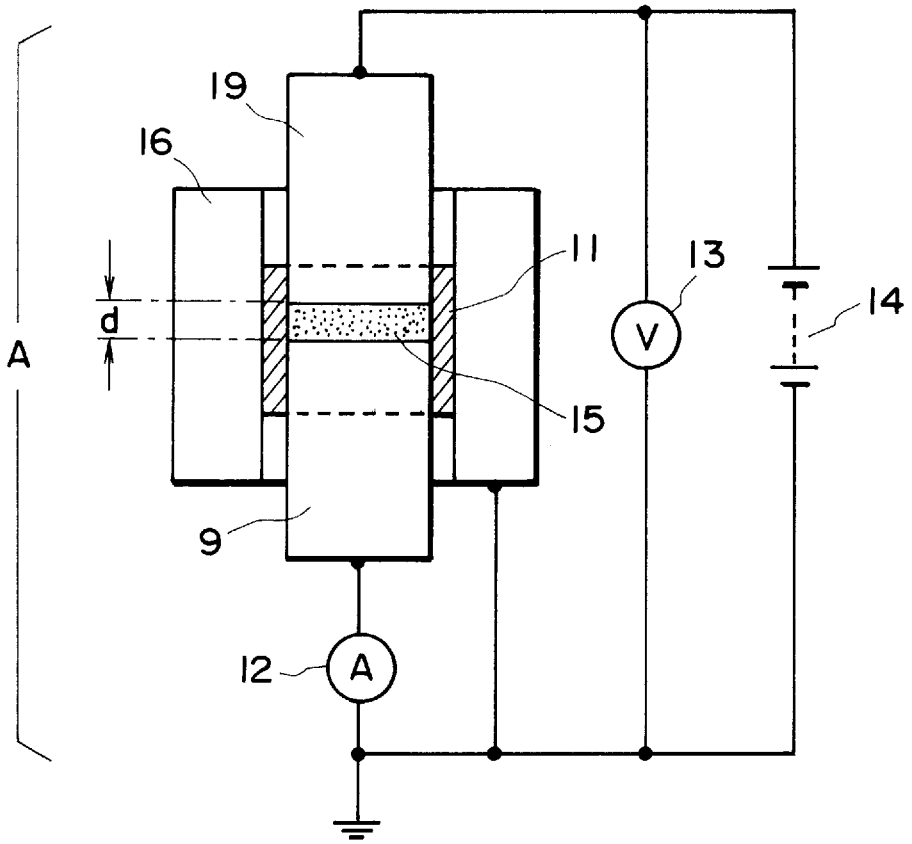
FIG. 2 is a schematic illustration of an apparatus for measuring the volume resistivity of magnetic particles suitably used in the present invention.

A cell A as shown in FIG. 2 is used. Into the cell A having a sectional area S (=2 $cm^2$) and held in a guide ring 16 via an insulating material 11, magnetic particles 15 are placed, and a principal electrode 9 and an upper electrode 10 are disposed to sandwich the magnetic particles 15 in a thickness d (=1 mm), under a load of 10 kg. Under this state, a voltage of 100 volts supplied from a constant voltage supply 14 and measured by a volt meter 13 is applied, and a current passing through the sample magnetic particles 15 is measured by an ammeter 12 in an environment of 23° C. and 65%.

The magnetic particles may preferably have an average particle size of 5–200 μm. Below 5 μm, the attachment of magnetic brush onto the photosensitive member is liable to occur and, above 200 μm, dense erected ears of magnetic brush cannot be formed on the sleeve, thus being liable to cause charging failure. The average particle size may more preferably be 10–100 μm, particularly 10–50 μm, so as to increase the surface area of the magnetic particles and suppress the adverse effect of the toner melt-sticking. The average particle size may be determined as an average of maximum axial lengths in horizontal direction of 100 particles selected at random by observation through an optical microscope or a scanning electron microscope (SEM), The magnetic particles used in the present invention may be surface-coated. Such surface-coated magnetic particles may have coating forms roughly classified as follows. That is, core magnetic particles are surface-coated with (1) a resin layer comprising a binder resin with electroconductive particles dispersed therein or (2) inorganic substance sticking thereto. The resultant surface-coating layer need not completely cover the core particles, but the core particles can be exposed through the surface layer. The surface layer can even be formed discretely within an extent of accomplishing the effect of the present invention.

The core magnetic particles may comprise an alloy or compound containing a ferromagnetic element, such as iron, cobalt or nickel so as to provide magnetic particles forming ears erected under the action of a magnetic field to form a magnetic brush. These may be modified by oxidation or reduction or modified with respect to a composition into a ferrite having an adjusted composition, Zn—Cu ferrite reduced with hydrogen or oxidized magnetite so as to provide a preferable range of volume resistivity. The volume resistivity may preferably be in the range of $1\times10^4$ ohm.cm–$1\times10^{10}$ ohm.cm, more preferably $1\times10^4$–$1\times10^9$ ohm.cm, further preferably $1\times10^4$–$1\times10^7$ ohm.cm, so that an appropriate charging performance is retained similarly as in the initial stage even if the surface layer is partially peeled off.

In the case where the magnetic particles assume the coating form (1) above, examples of the electroconductive particles may include particles of metals, such as copper, nickel, iron, aluminum, gold and silver, metal oxides, such as iron oxide, ferrite, zinc oxide, tin oxide, antimony oxide and titanium oxide; and carbon black. These electroconductive particles may preferably have a volume resistivity of at most $1\times10^7$ ohm.cm and a particle size of at most 1 μm. The electroconductive particles may have been surface-treated, as desired for the purpose of hydrophobicity-imparting and charging control.

Examples of the binder resin may include: homopolymers and copolymers of styrenes, such as styrene and chlorostyrene; mono-olefins, such as ethylene, propylene, butylene and isobutylene; vinyl esters, such as vinyl acetate, vinyl propionate, vinyl benzoate and vinyl lactate; α-methylene-aliphatic monocarboxylic acid esters, such as methyl acrylate, ethyl acrylate, butyl acrylate, dodecyl acrylate, acryl actylate, phenyl acrylate, methyl methacrylate, ethyl methacrylate, butyl methacrylate, and dodecyl methacrylate; vinyl ethers, such as vinyl methyl ether, vinyl ethyl ether and vinyl butyl ether; vinyl ketones, such as vinyl methyl ketone, vinyl hexyl ketone and vinyl isopropenyl ketone. Examples of particularly representative binder resins may include; polystyrene, styrene-alkyl acrylate copolymer, styrene-acrylonitrile copolymer, styrene-butadiene copolymer in view of dispersibility of electroconductive particles, film-forming characteristic for constituting the surface layer, prevention of toner melt-sticking and productivity. Further examples may include: polycarbonate, phenolic resin, polyester, polyurethane, epoxy resin, polyolefin, fluorine-containing resin, silicone resin and polyamide. Particularly, in order to prevent the toner melt-sticking, it is preferred that the surface layer contain a resin having a low critical surface tension, such as polyolefin, fluorine-containing resin and silicone resin.

Examples of fluorine-containing resins as a binder resin may include solvent-soluble copolymers of fluorine-containing monomers, such as vinyl fluoride, vinylidene fluoride, trifluoroethylene, chlorotrifluoroethylene, dichlorodifluoroethylene, tetrafluoroethylene and hexafluoropropylene, with another monomer.

Examples of the silicone resin as a binder resin may include: KR271, KR282, KR311, KR255, KR155 (straight silicone varnish), KR211, KR212, KR216, KR 213, KR 217, KR9218 (modifying silicone varnish). SA4, KR206, KR5206 (silicone alkyl varnished), ES1001, ES1001N, ES1002T, ES1004 (silicone epoxy varnish), KR9706 (silicone acrylic varnish), KR5203 and KR5221 (silicone polyester varnish), respectively available from Shin-Etsu Silicone K.K.; and SR2100, SR2101, SR2107, SR2110, SR2108, SR2109, SR2400, SR2410, SR2411, SH805, SH806 and SH840, respectively available from Toray Silicone K.K.

The fluorine-containing resin, polyolefin resin or silicone resin may preferably occupy 1.0–60 wt. %, particularly 2.0–40 wt. %, of the total binder resin in the surface layer. If the content is below 1.0 wt. %, the surface modifying effect is insufficient to result in a low toner melt-sticking preventing effect. On the other hand, if the content is above 60 wt. %, mutual dispersion of constituent resins becomes difficult to result in a local irregularity in volume resistivity, thus being liable to result in inferior charging characteristic.

In the present invention, the surface layer may preferably have a volume resistivity of at most $1\times10^9$ ohm.cm, more preferably $1\times10^4$–$1\times10^9$ ohm.cm, further preferably $1\times10^4$–$1\times10^7$ ohm.cm.

The surface layer may preferably be applied in an amount (as solid matter) of 0.5–20 wt. % of the weight of the core. If the coating amount is below 0.5 wt. %, a sufficient coating effect may not be attained, thus being liable to show an insufficient toner melt-sticking prevention effect. A coating amount in excess of 20 wt. % is not only economically disadvantageous but also can decrease the magnetic performance of the coated magnetic particles.

Further, in the present invention, in order to retain a contact nip between the charging member and the charge injection layer of the photosensitive member for printing on a large number of sheets and retain a good chargeability, the surface layer of the charging member may preferably contain lubricating particles.

Such lubricating particles may preferably comprise particles of a resin having a low critical surface tension, such as fluorine containing resin, silicone resin or polyolefin resin. It is particularly preferred to use polytetrafluoroethylene (PTFE) resin particles. In such a case, the lubricating particles may preferably be added in an amount of 2–50 wt. %, particularly 5–40 wt. %, of the total binder resin in the surface layer.

The magnetic particles having a surface layer may be produced through a process wherein the electroconductive particles and the binder resin are dispersed and dissolved in an appropriate solvent, followed preferably by further dispersing of the lubricating particles, to form a surface layer-coating liquid, followed further by immersion or dispersion of the core particles and spray drying to evaporate the solvent; or a process wherein a fluidized bed of core particles is formed in a fluidized bed coating apparatus, and a surface layer-coating liquid as described above is sprayed onto the core particles in the fluidized bed to gradually form the surface layer under drying. In this instance, it is preferred that the lubricating particles are not mutually dissolved with the binder resin.

In the case where the magnetic particles are coated with an inorganic substance different from the material of the magnetic particles, examples of the inorganic substance may include: triirontetroxide, γ-iron oxide, α-iron oxide, various ferrites, titanium black (titanium monoxide), electroconductive tin oxide, electroconductive zinc oxide, and various electroconductive metals. In the present invention, the coated magnetic particles are used to form a magnetic brush, so that the inorganic substance may preferably comprise a magnetic material, such as γ-iron oxide, various ferrite and magnetic metal.

In the present invention, the surface layer may preferably have a volume resistivity of at most $10^9$ ohm.cm, more preferably $1\times10^4$–$1\times10^9$ ohm.cm, further preferably $1\times10^4$–$1\times10^7$ ohm.cm, which is preferably lower than the volume resistivity of the core material.

The surface layer may preferably be coated in an amount of 0.01–10 wt. % of the core material. Below 0.01 wt. %, the toner melt-sticking preventing effect is liable to be insufficient. Above 10 wt. %, the surface conduction becomes predominant, so that leakage is liable to occur at the time of voltage application. The coating amount may preferably be 0.1–5 wt. %.

The magnetic particles having a surface layer may be formed through a process wherein an inorganic substance as described above is attached onto the surface of sintered (e.g., ferrite) magnetic particles and then subjected to further sintering or a process wherein an inorganic substance as described above is deposited on the surface of the magnetic particles.

The volume resistivity of such a surface layer or film referred to herein is based on values measured in the following manner.

A ca. 100 μm-thick polyethylene terephthalate (PET) film surface-coated with a vapor-deposited gold layer is provided and further coated with a ca. 10 μm-thick layer of a sample surface layer-forming substance, then subjected to measurement by using a volume resistivity measurement apparatus ("4140B pAMATER", available from Hewlett-Packard Co.) under application of a voltage of 100 volts in an environment of 23° C. and 65% RH.

The photosensitive member used in the present invention has a charge-injection layer as a layer most distant from the support, i.e., a surface layer. The charge-injection layer may preferably have a volume resistivity of $1\times10^8$ ohm.cm–$1\times10^{15}$ ohm.cm so as to have a sufficient chargeability and avoid image flow. It is particularly preferred to have a volume resistivity of $1\times10^{10}$ ohm.cm–$1\times10^{15}$ ohm.cm, in order to avoid the image flow, further preferably $1\times10^{12}$–$1\times10^{15}$ ohm.cm in view of environmental change. Below $1\times10^8$ ohm.cm, charge carrier is not retained along the surface in a high-humidity environment, thus being liable to cause image flow. Above $1\times10^{15}$ ohm.cm, charge cannot be sufficiently injected from the charging member and retained, thus being liable to cause a charging failure. By disposing a functional layer at the photosensitive member surface, charge injected from the charging member is retained therein, and further the change is allowed to flow to the support of the photosensitive member at the time of light exposure to reduce the residual potential. Further, by using the charging member and the photosensitive member according to the present invention, the charge initiation voltage Vth can be lowered and the photosensitive member charge potential can be converged to a value which is almost 90% or above the applied voltage to the charging member. For example, under ordinary charging condition (e.g., under application of a DC voltage of 100–2000 volts and a process speed of at most 1000 mm/min), it has become possible to effect an injection charging such that the photosensitive member having a charge-injection layer is charged to a potential which is at least 80%, preferably at least 90%, of a voltage applied to the charging member. This is a substantially larger value than, e.g., ca. 30%, i.e., a potential of ca. 200 volts in response to an applied DC voltage of 700 volts, in the case of conventional contact charging based on discharging.

The volume resistivity values of the charge injection layer described herein are based on values measured according to a method identical to the one used for measuring the volume resistivity of a surface layer-forming material. That is, a charge injection layer is formed on a conductive film (Au) -deposited PET film and subjected to measurement of a volume resistivity by using a volume resistivity measurement apparatus ("4140B pAMATER", available from Hewlett-Packard Co.) under application of a voltage of 100 volts in an environment of 23° C. and 65% RH.

The charge injection layer may be formed as an inorganic layer, such as a metal vapor-deposition layer, or a resin layer containing electroconductive particles dispersed therein. Such an inorganic layer may be formed by vapor deposition, and a conductive particles-dispersed resin layer may be formed by an appropriate coating method, such as dipping, spraying, roller coating or beam containing. Further, the charge injection layer can also be formed with a mixture or copolymer of an insulating binder resin and a light-transmissive resin having a high ion-conductivity, or a photoconductive resin having a medium resistivity alone. In order to constitute the conductive particle-dispersed resin layer, the electroconductive particles may preferably be added in an amount of 2–190 wt. % of the binder resin. Below 2 wt. %, a desired volume resistivity cannot be readily obtained and, above 190 wt. %, the charge injection layer is caused to have a lower film strength and is therefore liable to be worn out by scraping, thus resulting in a short life of the photosensitive member.

The preferred embodiment of the photosensitive member will now be described, wherein the following layers may be included preferably in an order appearing hereinafter.

An electroconductive support is generally used, which may comprise a metal, such as aluminum or stainless steel, a plastic coated with a layer of aluminum alloy or indium oxide-tin oxide alloy, paper or a plastic sheet impregnated with electroconductive particles, or a plastic comprising an electroconductive polymer in a shape of a cylinder or a sheet.

On the electroconductive support, it is possible to dispose an undercoating layer for the purpose of providing an improved adhesion and applicability of the photosensitive layer, protection of the support, coverage of defects on the support, an improved charge injection from the support, and protection of the photosensitive layer from electrical breakage. The undercoating layer may comprise polyvinyl alcohol, poly-N-vinylimidazole, polyethylene oxide, ethyl cellulose, methyl cellulose, nitrocellulose, ethylene-acrylic acid copolymer, polyvinyl butyral, phenolic resin, casein, polyamide, copolymer nylon, glue, gelatin, polyurethane, or aluminum oxide. The thickness may ordinarily be 0.1–3 $\mu$m.

A charge generation layer may comprise a charge generation substance, examples of which may include: organic substances, such as azo pigments, phthalocyanine pigments, indigo pigments, perylene pigments, polycyclic quinone pigments, pyrylium salts, thiopyrilium salts, and triphenylmethane dyes; and inorganic substances, such as selenium and amorphous silicon, in the form of a dispersion in a film of an appropriate binder resin or a vapor deposition film thereof. The binder resin may be selected from a wide variety of resins, examples of which may include polycarbonate resin, polyester resin, polyvinyl butyral resin, polystyrene resin, acrylic resin, methacrylic resin, phenolic resin, silicone resin, epoxy resin, and vinyl acetate resin. The binder resin may be contained in an amount of at most 80 wt. %, preferably 0–40 wt. %, of the charge generation layer. The charge generation layer may preferably have a thickness of at most 5 $\mu$m, preferably 0.05–2 $\mu$m.

A charge transport layer has a function of receiving charge carriers from the charge generation layer and transporting the carriers under an electric field. The charge transport layer may be formed by dissolving a charge transporting substance optionally together with a binder resin in an appropriate solvent to form a coating liquid and applying the coating liquid. The thickness may ordinarily be 0.5–40 $\mu$m. Examples of the charge transporting substance may include: polycyclic aromatic compounds having in then main chain or side chain a structure such as biphenylene, anthracene, pyrene or phenanthrene; nitrogen-containing cyclic compounds, such as indole, carbazole, oxadiazole, and pyrazoline; hydrazones, styryl compounds, selenium, selenium-tellurium, amorphous silicon and cadmium sulfide.

Examples of the binder resin for dissolving or dipersing therein the charge transporting substance may include: resins, such as polycarbonate resin, polyester resin, polystyrene resin, acrylic resins, and polyamide resins; and organic photoconductive polymers, such as poly-N-vinylcarbozole and polyvinylanthracene.

The charge injection layer may comprise a binder resin, examples of which may include; polyester, polycarbonate, acrylic resin, epoxy resin, phenolic resin, and curing agents of these resins. These may be used singly or in combination of two or more species. Further, in case of dispersing a large amount of electroconductive particles, it is preferred to use a reactive monomer or reactive oligomer with electroconductive particles dispersed therein and, after application thereof onto the photosensitive member surface, cure the applied resin under exposure to light or heat. Further, in case where the photosensitive layer comprises amorphous silicon, it is preferred to dispose a charge injection layer comprising SiC.

The electroconductive particles dispersed in the binder resin of the charge injection layer may for example comprise a metal or a metal oxide. It is preferred to use ultra-fine particles of zinc oxide, titanium oxide, tin oxide, antimony oxide, indium oxide, bismuth oxide, tin oxide-coated titanium oxide, tin-coated indium oxide, antimony-coated tin oxide, and zirconium oxide. These may be used singly or in combination of two or more species. In the case of dispersing particles in the charge injection layer, the particles are required to have a particle size which is smaller than the wavelength of light incident thereto, so as to avoid scattering of the incident light width the dispersed particles. Accordingly, the electroconductive particles, and other particles, if any, dispersed in the protective layer may preferably have a particle size of at most 0.5 $\mu$m.

The charge injection layer may preferably further contain lubricant particles, so that a contact (charging) nip between the photosensitive member and the charging member at the time of charging becomes enlarged thereby due to a lowered friction therebetween, thus providing an improved charging performance. The lubricant powder may preferably comprise a fluorine-containing resin, silicone resin or polyolefin resin having a low critical surface tension. Polytetrafluoroethylene (PTFE) resin is further preferred. In this instance, the lubricant powder may be added in 2–50 wt. %, preferably 5–40 wt. %, of the binder resin. Below 2 wt. %, the lubricant is insufficient, so that the improvement in charging performance is insufficient. Above 50 wt. %, the image resolution and the sensitively of the photosensitive member are remarkably lowered.

The charge injection layer may preferably have a thickness of 0.1–10 $\mu$m, particularly 1–7 $\mu$m.

Hereinbelow, some Production Examples are presented for illustrating structure and materials of member used.

[Toner Production Example 1]

| | |
|---|---|
| Styrene/butyl methacrylate copolymer (copolymerization wt. ratio = 75/25) | 100 wt. part(s) |
| Magnetite | 60 wt. part(s) |
| Metal-containing azo pigment | 0.5 wt. part(s) |
| Low-molecular weight polypropylene | 3 wt. part(s) |

The above ingredients were blended in a Henschel mixer and melt-kneaded through an extruded set at 130° C. After being cooled, the melt-kneaded product was coarsely crushed by a cutting mill, finely pulverized by a jet mill using a jet stream and pneumatically classified to obtain black powder (magnetic toner particles) having a weight-average particle size of 12 $\mu$m. To 10 wt. parts of the black powder, 1.2 wt. parts of silica hydrophobized (i.e., hydrophobicity-imparted) with silicone oil, and the resultant mixture was blended by a Henschel mixer to obtain a magnetic toner.

[Toner Production Example 2]

A magnetic toner having a weight-average particle size of 7 $\mu$m was prepared in a similar manner as in Production Example 1 except that the binder resin was changed to styrene/butyl acylate copolymer (copolymerization wt.

ratio=80/20), the amount of the magnetite was changed to 100 wt. parts, and the amount of the metal-containing azo pigment was changed to 2 wt. parts.

[Photosensitive member Production Example 1]

An OPC-type negatively chargeable photosensitive member was prepared by disposing the following 5 layers about a 30 mm-dia. aluminum cylinder.

A first layer was a ca. 20 μm-thick electroconductive particle-dispersed resin layer (electroconductive layer) for smoothening defects on the aluminum cylinder and preventing occurrence of noise due to reflection of exposure laser light.

A second layer was a positive charge injection-preventing layer (undercoating layer) for preventing positive charge injection from the aluminum support from diminishing negative charge provided to the photosensitive member surface and formed as a ca. 1 μm-thick layer with a medium level resistivity of ca. $10^6$ ohm.cm. with 6-66-610-12-nylon and methoxymethylated nylon.

A third layer was a ca. 0.3 μm-thick charge generation layer comprising a disazo pigment dispersed in a resin and functional to generate positive and negative charge pairs when exposed to laser light.

A fourth layer was a ca. 25 μm-thick charge-transport layer comprising hydrazone dispersed in polycarbonate resin so as to form a p-type semiconductor. Accordingly, a negative charge formed on the photosensitive member surface could not move through this layer so that positive charge generated in the charge generation layer alone was transported to the photosensitive member surface.

A fifth layer was a charge injection layer, a characteristic of the present invention, which comprised 100 wt. parts of a photocurable acrylic resin, 160 wt. parts of ca. 0.03 μm-dia. $SnO_2$ particles provided with a lower resistivity by doping with antimony, 0.25 μm-dia. tetrafluoroethylene resin particles for providing an increased contact time, and 1.2 wt. % of a dispersant.

The charge injection layer was formed in a thickness of ca. 3 μm by spray coating of a liquid containing the above materials.

As a result, the volume resistivity of the photosensitive member surface layer was lowered to $1\times10^{13}$ ohm.cm in contrast with $1\times10^{15}$ ohm.cm in case of the charge transport layer alone.

[Photosensitive member Production Example 2]

A photosensitive member was prepared in the same manner as in Production Example 1 except that the fifth layer was formed without using any of the tetrafluoroethylene resin particles and the dispersant.

As a result, the volume resistivity of the photosensitive member surface layer was lowered to $2\times10^{12}$ ohm.cm.

[Photosensitive member Production Example 3]

A photosensitive member was prepared in the same manner as in Production Example 1 except that the fifth layer was formed by dispersing 300 wt. parts of the ca. 0.03 μm-dia. antimony-doped $SnO_2$ particles in 100 wt. parts of photocurable acrylic resin.

The volume resistivity of the surface layer was $2\times10^7$ ohm.cm.

[Photosensitive member Production Example 4]

A photosensitive member was prepared in the same manner as in Production Example 1 except for using 30 wt. parts of the tetrafluoroethylene resin particles. The resultant surface layer volume volume resistivity of $5\times10^{12}$ ohm.cm.

[Photosensitive member Production Example 5]

A photosensitive member was prepared in the same manner as in Production Example 1 except for using 300 wt. parts of $SnO_2$ particles. The resultant surface layer showed a volume resistivity of $4\times10^7$ ohm.cm.

[Magnetic particle Production Example 1]

Magnetic particles coated with an electroconductive particles-containing resin layer for a charging member were prepared.

First, 1 wt. part of polycarbonate, 1 wt. part of epoxy-etherified silicone resin, 4 wt. parts of electroconductivity-imparted titanium oxide particles (electroconductive particles) and 0.2 wt. part of 0.25 μm-dia. tetrafluoroethylene resin particles, were mixed with 14 wt. parts of solvent xylene. The resultant mixture liquid was placed in a paint shaker containing glass beads and subjected to 2 hours of dispersion, to prepare a surface layer-coating liquid.

A layer was prepared from the coating liquid and subjected to measurement of volume resistivity in the above-described manner, whereby a volume resistivity of $8\times10^6$ ohm.cm was measured.

Then, the coating liquid was applied onto 200 wt. parts of hydrogen-reduced Zn—Cu ferrite particles having an average particle size of 40 μm and a volume resistivity of $5\times10^6$ ohm.cm by using a fluidized bed-type coating apparatus ("SPIRACOATER" mfd. by Okada Seikosho K.K.) and dried.

The resultant coated-magnetic particles showed a volume resistivity of $3\times10^6$ ohm.cm as a result of measurement in the above-described manner. When the surface of the coated magnetic particles was observed through a SEM (scanning electronmicroscope) ("S800", mfd. by Hitachi Seisakusho K.K.), the presence of a surface layer was confirmed over the entire surface.

[Magnetic particle Production Example 2]

A surface layer-coating liquid was prepared in the same manner as in Production Example 1 except that 4 wt. parts of electroconductivity-imparted tin oxide particles were used as the electroconductive particles and the mixture was subjected to 3 hours of dispersion in the paint shaker. The coating layer provided a surface layer showing a volume resistivity of $8\times10^6$ ohm.cm.

Then, the coating liquid was used for coating 200 wt. parts of the same ferrite particles by using the same fluidized bed-type coating apparatus as in Production Example 1 and dried to provide coated magnetic particles showing a volume resistivity of $5\times10^6$ ohm.cm. As a result of the SEM observation, the presence of a surface layer on the entire surface was confirmed.

[Magnetic particle Production Example 3]

A surface layer-coating liquid was prepared in the same manner as in Production Example 1 except that 1 wt. part of polycarbonate resin and 1 wt. part of fluorine-containing resin were used as the binder resin and the mixture was subjected to 3 hours of dispersion in the paint shaker. The coating layer provided a surface layer showing a volume resistivity of $8\times10^6$ ohm.cm.

Then, the coating liquid was used for coating 200 wt. parts of the same ferrite particles by using the same fluidized bed-type coating apparatus as in Production Example 1 and dried to provide coated magnetic particles showing a volume resistivity of $7\times10^6$ ohm.cm. As a result of the SEM observation, the presence of a surface layer on the entire surface was confirmed.

[Magnetic particle Production Example 4]

The surface layer-coating liquid of Production Example 1 was applied onto 200 wt. parts of ferrite particles having an average particle size of 42 μm and a volume resistivity of $2\times10^9$ ohm.cm by using the same fluidized bed-type coating apparatus as in Production Example 1 and dried to provide coated magnetic particles showing a volume resistivity of $9\times10^6$ ohm.cm. As a result of the SEM observation, the presence of a surface layer on the entire surface was confirmed.

[Magnetic particle Production Example 5]

The surface layer-coating liquid of Production Example 1 was applied onto 200 wt. parts of hydrogen-reduced magnetite particles having an average particle size of 40 $\mu$m and a volume resistivity of $6\times10^3$ ohm.cm. by using the same fluidized bed-type coating apparatus as in Production Example 1 and dried to provide coated magnetic particles showing a volume resistivity of $9\times10^6$ ohm.cm. As a result of the SEM observation, the presence of a surface layer on the entire surface was confirmed.

[Magnetic particle Production Example 6]

A surface layer-coating liquid was prepared in the same manner as in Production Example 1 except that 2 wt. parts of epoxy-modified silicone resin was used as the binder resin and the mixture was subjected to 4 hours of dispersion in the paint shaker. The coating layer provided a surface layer showing a volume resistivity of $8\times10^6$ ohm.cm.

Then, the coating liquid was used for coating 200 wt. parts of the same ferrite particles by using the same fluidized bed-type coating apparatus as in Production Example 1 and dried to provide coated magnetic particles showing a volume resistivity of $4\times10^6$ ohm.cm. As a result of the SEM observation, the presence of a surface layer on the entire surface was confirmed.

[Magnetic particle Production Example 7]

1 wt. part of epoxy-etherified silicone resin and 3 wt. parts of electroconductivity-imparted titanium oxide particles were dissolved or dispersed in 16 wt. parts of xylene and the mixture was subjected to 2 hours of dispersion in the paint shaker. The coating layer provided a surface layer showing a volume resistivity of $8\times10^6$ ohm.cm.

Then, the coating liquid was used for coating 200 wt. parts of hydrogen-reduced Zn—Cu ferrite particles having an average particle size of 40 $\mu$m and a volume resistivity of $5\times10^6$ ohm.cm by using the same fluidized bed-type coating apparatus as in Production Example 1 and dried to provide coated magnetic particles showing a volume resistivity of $2\times10^6$ ohm.cm. As a result of the SEM observation, the presence of a surface layer on the entire surface was confirmed.

[Magnetic particle Production Example 8]

1 wt. part of phenolic resin and 3 wt. parts of electroconductivity-imparted tin oxide particles were dissolved or dispersed in 16 wt. parts of xylene and the mixture was subjected to 3 hours of dispersion in the paint shaker. The coating layer provided a surface layer showing a volume resistivity of $2\times10^6$ ohm.cm.

Then, the coating liquid was used for coating 200 wt. parts of the same ferrite particles by using the same fluidized bed-type coating apparatus as in Production Example 1 and dried to provide coated magnetic particles showing a volume resistivity of $4\times10^6$ ohm.cm. As a result of the SEM observation, the presence of a surface layer on the entire surface was confirmed.

[Magnetic particle Production Example 9]

The surface layer-coating liquid of Production Example 1 was applied onto ferrite particles having an average particle size of 42 $\mu$m and a volume resistivity of $2\times10^9$ ohm.cm by using the same fluidized bed-type coating apparatus as in Production Example 1 and dried to provide coated magnetic particles showing a volume resistivity of $9\times10^6$ ohm.cm. As a result of the SEM observation, the presence of a surface layer on the entire surface was confirmed.

[Magnetic particle Production Example 10]

The surface layer-coating liquid of Production Example 1 was applied onto 200 wt. parts of hydrogen-reduced magnetite particles having an average particle size of 40 $\mu$m and a volume resistivity of $6\times10^3$ ohm.cm by using the same fluidized bed-type coating apparatus as in Production Example 1 and dried to provide coated magnetic particles showing a volume resistivity of $9\times10^6$ ohm.cm. As a result of the SEM observation, the presence of a surface layer on the entire surface was confirmed.

[Magnetic particle Production Example 11]

1 wt. part of straight silicone resin and 0.035 wt. part of electroconductive carbon black were dissolved or dispersed in 16 wt. parts of xylene and the mixture was subjected to 3 hours of dispersion in the paint shaker. The coating layer provided a surface layer showing a volume resistivity of $1\times10^7$ ohm.cm.

Then, the coating liquid was used for coating 200 wt. parts of hydrogen-reduced Zn—Cu ferrite particles having an average particle size of 34 $\mu$m and a volume resistivity of $2\times10^7$ ohm.cm by using the same fluidized bed-type coating apparatus as in Production Example 1, dried and further heated at 120° C. to provide coated magnetic particles showing a volume resistivity of $1\times10^7$ ohm.cm. As a result of the SEM observation, the presence of a surface layer on the entire surface was confirmed.

[Magnetic particle Production Example 12]

1 wt. part of magnetic particles having an average particle size of 0.3 $\mu$m and a volume resistivity of $5\times10^3$ ohm.cm were dispersively attached to Zn—Cu ferrite particles having an average particle size of 20 $\mu$m and a volume resistivity of $2\times10^6$ ohm.cm, followed by resintering, to obtain coated magnetic particles, which showed a volume resistivity of $9\times10^5$ ohm.cm.

[Magnetic particle Production Example 13]

1 wt. part of black titanium oxide (titanium black) particles having an average particle size of 0.2 $\mu$m and a volume resistivity of $8\times10^3$ ohm.cm were dispersively attached to Zn—Cu ferrite particles having an average particle size of 30 $\mu$m and a volume resistivity of $5\times10^6$ ohm.cm, followed by resintering, to obtain coated magnetic particles, which showed a volume resistivity of $8\times10^5$ ohm.cm.

[Magnetic particle Production Example 14]

1 wt. part of magnetic particles having an average particle size of 0.3 $\mu$m and a volume resistivity of $5\times10^3$ ohm.cm were dispersively attached to Zn—Cu ferrite particles having an average particle size of 60 $\mu$m and a volume resistivity of $3\times10^6$ ohm.cm, followed by resintering, to obtain coated magnetic particles, which showed a volume resistivity of $8\times10^5$ ohm.cm.

[Magnetic particle Production Example 15]

The ferrite particles before the surface layer coated in Production Example 1 were used as they were.

[Magnetic particle Production Example 16]

The ferrite particles before the surface layer coated in Production Example 4 were used as they were.

[Magnetic particle Production Example 17]

The ferrite particles before the surface layer coated in Production Example 5 were used as they were.

[Magnetic particle Production Example 18]

Zn—Cu ferrite particles having an average particle size of 60 $\mu$m and a volume resistivity of $5\times10^{10}$ ohm.cm were used as they were.

[Magnetic particle Production Example 19]

Magnetite particles having an average particle size of 40 $\mu$m and a volume resistivity of $4\times10^3$ ohm.cm were used as they were.

[EXAMPLE 1]

A photosensitive member and a contact charging member as descried above may be used for charging in principle as follows. According to the present invention, a charging member having a medium level of resistance is used to inject charge to the surface of a photosensitive member having a medium level surface resistivity. In this embodiment, a charge is not injected to a trap potential level of the photosensitive member but is injected to charge the electroconductive particles in the charge injection layer to charge the photosensitive member as a whole.

More specifically, a charge is stored in a minute capacitor functionally formed by a charge transport layer functioning as a dielectric layer, and an aluminum support and a layer of electroconductive particles in the charge injection layer functioning as two electrode plates. In this instance, the electroconductive particles are electrically independent from each other, and each constitute a minute floating electrode. As a result, the photosensitive member surface appears to be macroscopically uniformly charged, but actually an enormous number of charged electroconductive particles cover the photosensitive member surface. Therefore, when imagewise exposure is performed by laser scanning, an electrostatic latent image can be retained because individual electroconductive particles are electrically independent.

In a specific Example, an electrophotographic printer as show in FIG. 1 was constituted by using a photosensitive member 1 prepared by Photosensitive member Production Example 1 and a charging member 2 including coated magnetic particles 2*a* prepared in Magnetic particle Production Example 1 and used for successive image formation at a process speed of 100 mm/sec in an environment of 23° C. and 65% RH.

More specifically, the charging member 2 comprised coated magnetic particles 2*a* prepared in Magnetic particle Production Example 1, which were caused to form a magnetic brush with erected ears on a non-magnetic sleeve 2*b* formed under a magnetic field given by a magnet roller 2*c* enclosed within the sleeve 2*b*. The magnetic particles 2*a* were applied in an initial thickness of ca. 1 mm so to form a magnetic brush forming a contact nip in a width of ca. 5 mm with the photosensitive member 1. The magnetic particle-holding sleeve 2*b* was initially disposed with a gap of ca. 500 μm from the photosensitive member 1. The magnetic roller 2*c* was held immovably within the sleeve 2*b*, and the sleeve surface was caused to move at a speed identical to the peripheral speed but in a reverse direction with the rotation of the photosensitive member 1, so as to cause a uniform contact between the photosensitive member 1 and the magnetic brush 2*a*.

Incidentally, in case where no difference in peripheral speed is provided between the magnetic brush and the photosensitive member, the magnetic brush is liable to fail to retain an appropriate nip, thus resulting in charging failure, at the time of circumferential or axial deviation pushing the magnetic brush away, since the magnetic brush per se lacks a physical restoration force. For this reason, it is preferred that the magnetic brush is always pushed against the photosensitive member with its fresh surface. Accordingly, in this Example the magnetic brush-holding sleeve 2*b* was rotated at an identical speed in a reverse direction with the photosensitive member 1.

The image formation was performed in the following manner.

The charging member 2 supplied with a DC voltage of −700 volts was caused to contact the photosensitive member 1 with its magnetic brush 2*a* while rotating relative to the photosensitive member 1, thereby surface-charging the photosensitive member 1. Then, at an exposure position, the charged photosensitive member 1 was exposed to imagewise scanning laser light 3 from a laser diode subjected to intensity modulation based on given image signals with the aid of a polygonal mirror, thereby forming an electrostatic latent image on the photosensitive member 1.

Then, the electrostatic latent image formed on the photosensitive member 1 was subjected to reversal development with a magnetic one-component insulating toner produced in Toner Production Example 1 above applied on a non-magnetic sleeve 4 of 16 mm in diameter enclosing a magnet therein. The sleeve 4 was disposed to have a fixed gap of 300 μm from the photosensitive member at the developing position and rotated at an equal peripheral speed. The sleeve 4 was supplied with a DC bias voltage of −500 volts superposed with a rectangular AC voltage with a peak-to-peak voltage of 1600 volts and a frequency of 1800 Hz, so as to effect a jumping development between the sleeve and the photosensitive member.

The thus developed toner image was then transferred to plain paper 6 by using a transfer roller 5 having a medium resistance of $5\times10^8$ ohm and supplied with a DC voltage of +2000 volts.

The plain paper sheet 6 carrying the transferred toner image was then passed between hot fixing rollers 8 to fix the toner image onto the paper sheet, and the sheet carrying the fixed image was discharged out of the apparatus. Residual toner not transferred to the paper 6 and remaining on the photosensitive member 1 was then scraped off the photosensitive member surface by a cleaning blade 7, and the cleaned photosensitive member surface was prepared for a subsequent cycle of image formation.

Furthermore, in the present invention, plural members among the above-mentioned photosensitive member 1, charging member 2, developing means including the sleeve 4 and cleaning means 7 can be integrally supported to form a process cartridge, which is detachably mountable to a main body of an electrophotographic apparatus, such as a copying machine, a laser beam printer and a facsimile apparatus. For example, at least one of the charging means 2, developing means 2 and cleaning means 7 can be integrally supported with the photosensitive member 1 to form a cartridge, which can be attached-to and released from an apparatus main body with the aid of a guide means, such as a guide rail provided in the apparatus main body.

Incidentally, it is to be understand that the above-mentioned structure and process conditions have been set forth as a mere examples and can be modified within the scope of the present invention.

In this particular Example, as a result of image formation by using a printer of the above-described structure, the photosensitive member 1 initially having a surface potential of 0 volt was charged up to −680 volts by once passing through the contact nip with the magnetic brush under application of a DC voltage of −700 volts to the sleeve 2*b*, thus showing a good charging performance. At this time, even when pinholes occurred on the photosensitive member, the current leakage did not occur. Further, the attachment of magnetic particles constituting the magnetic brush 2*a* did not occur, whereby good solid black and solid white images could be obtained. Further, even after 4000 sheets of successive image formation, the charging performance was similar to that in the initial stage, whereby good solid black and solid white images could be obtained. The image evaluation was performed with eyes.

Further, in the reversal development, the transfer charging polarity is opposite to the surface potential polarity on the photosensitive member, so that the potential history on the photosensitive member affects the charging performance in a subsequent cycle. In order to evaluate the phenomenon, in this Example, an A4-size longitudinal original image including a solid black image (having a low potential as an absolute value) in a width of ca. 94 mm (corresponding to one peripheral length of the 30 mm.dia. photosensitive member) and also a subsequent solid white image (having a high potential as an absolute value) to evaluate a fog in the sold white image (evaluation of charging ghost). In the charging ghost evaluation, a solid white image following a solid black image according to the reversal development scheme is liable to be accompanied with fog due to an insufficient increase in potential for providing the solid white image, unless the charging member exhibits a good charging performance. In this Example, however, no fog was observed during the successive reproductions of the above-mentioned original image including the solid black and solid white images.

[EXAMPLE 2]

Image formation and evaluation were performed in the same manner as in Example 1 except that the coated magnetic particles prepared in Magnetic particle Production Example 2 were used. As a result of 4000 sheets of successive image formation, the charging performance was similar to that in the initial stage, whereby good solid black and solid white images could be obtained.

[EXAMPLE 3]

Image formation and evaluation were performed in the same manner as in Example 1 except that the coated magnetic particles prepared in Magnetic particle Production Example 3 were used. As a result of 4000 sheets of successive image formation, the charging performance was similar to that in the initial stage, whereby good solid black and solid white images could be obtained.

[EXAMPLE 4]

Image formation and evaluation were performed in the same manner as in Example 1 except that the coated magnetic particles prepared in Magnetic particle Production Example 4 and the photosensitive member prepared in Photosensitive member Production Example 2 were used. As a result the initial performances were good but, in the charging ghost evaluation after successive image formation on 2000 sheets, solid images were accompanied with slight fog which might be attributable to charging failure caused by partial peeling of the surface layer on the coated magnetic particles, while these difficulties were at a practically acceptable level.

[EXAMPLE 5]

Image formation and evaluation were performed in the same manner as in Example 1 except that the coated magnetic particles prepared in Magnetic particle Production Example 5 were used. As a result the initial performances were good but, after successive image formation on 2000 sheets, solid images were accompanied with several black spots which might be attributable to charging failure due to slight pinhole leakage caused by partial peeling of the surface layer on the coated magnetic particles, while these difficulties were at a practically acceptable level.

[EXAMPLE 6]

Image formation and evaluation were performed in the same manner as in Example 1 except that the coated magnetic particles prepared in Magnetic particle Production Example 6 were used. As a result of 4000 sheets of successive image formation, the charging performance was similar to that in the initial stage, whereby good solid black and solid white images could be obtained.

[EXAMPLE 7]

Image formation and evaluation were performed in the same manner as in Example 1 except that the coated magnetic particles prepared in Magnetic particle Production Example 7 were used. As a result of 4000 sheets of successive image formation, the charging performance was similar to that in the initial stage, whereby good solid black and solid white images could be obtained.

[EXAMPLE 8]

Image formation and evaluation were performed in the same manner as in Example 1 except that the coated magnetic particles prepared in Magnetic particle Production Example 8 and the photosensitive member prepared in photosensitive member Production Example 2 were used. As a result of 4000 sheets of successive image formation, good solid black and solid white images could be obtained from the initial stage to 4000 sheets, while the solid white images were accompanied with slight fog due to a slight charging insufficiency caused by a decrease in contact nip in the charging ghost evaluation.

[EXAMPLE 9]

Image formation and evaluation were performed in the same manner as in Example 1 except that the coated magnetic particles prepared in Magnetic particle Production Example 9 and the photosensitive member prepared in Photosensitive member Production Example 2 were used. As a result the initial performances were good but, in the charging ghost evaluation after successive image formation on 1000 sheets, solid images were accompanied with slight fog which might be attributable to charging failure caused by partial peeling of the surface layer on the coated magnetic particles, while these difficulties were at a practically acceptable level.

[EXAMPLE 10]

Image formation and evaluation were performed in the same manner as in Example 1 except that the coated magnetic particles prepared in Magnetic particle Production Example 10 were used. As a result the initial performances were good but, after successive image formation on 1000 sheets, solid images were accompanied with several black spots which might be attributable to charging failure due to slight pinhole leakage caused by partial peeling of the surface layer on the coated magnetic particles, while these difficulties were at a practically acceptable level.

[EXAMPLE 11]

Image formation and evaluation were performed in the same manner as in Example 1 except that the coated magnetic particles prepared in Magnetic particle Production Example 11 were used. As a result of 4000 sheets of successive image formation, the charging performance was similar to that in the initial stage, whereby good solid black and solid white images could be obtained.

[EXAMPLE 12]

Image formation and evaluation were performed in the same manner as in Example 1 except that the the process speed of the printer was changed to 94 mm/sec, the coated magnetic particles prepared in Magnetic particle Production Example 12 were used, the sleeve was rotated at a sped twice that of the peripheral speed of the photosensitive member in a reverse direction, and the toner prepared in Toner Production Example 2 was used. As a result of 4000 sheets of successive image formation, the charging performance was similar to that in the initial stage, whereby good solid black and solid white images could be obtained.

[EXAMPLE 13]

Image formation and evaluation were performed in the same manner as in Example 12 except that the coated magnetic particles prepared in Nagnetic particle Production Example 13 and the photosensitive member prepared in Photosensitive member Production Example 2 were used. As a result of 4000 sheets of successive image formation, good solid black and solid white images could be obtained from the initial stage to 4000 sheets, while the solid white images were accompanied with slight fog due to a slight charging insufficiency caused by a decrease in contact nip as a result of the charging ghost evaluation.

[EXAMPLE 14]

Image formation and evaluation were performed in the same manner as in Example 12 except that the coated magnetic particles prepared in Magnetic particle Production Example 14 were used. As a result of 4000 sheets of successive image formation, the initial performances were good but, from 1000 sheets to 4000 sheets, solid white images were accompanied with slight fog as a result of the charging ghost evaluation due to slight charging insufficiency, while these were at a practically acceptable level.

[Comparative Example 1]

Image formation and evaluation were performed in the same manner as in Example 1 except that magnetic particles prepared in Magnetic particle Production Example 15 were used. As a result, after 1000 sheets of successive image formation, toner melt-sticking occurred onto the magnetic particles whereby poor images were obtained (solid white images were accompanied with fog) due to charging failure.

[Comparative Example 2]

Image formation and evaluation were performed in the same manner as in Example 1 except that magnetic particles prepared in Magnetic particle Production Example 16 were used. As a result, from the initial stage, charging failure occurred on the whole area (causing fog in solid white images). Further, in order to charge the photosensitive member to a potential of −680 volts identical to that in Example 1, it was necessary to apply a voltage of −1000 volt. Substantially no charging was performed by application of −300 volts.

[Comparative Example 3]

Image formation and evaluation were performed in the same manner as in Example 1 except that magnetic particles prepared in Magnetic particle Production Example 17 were used. As a result, from the initial stage, solid white images were accompanied with black streaks caused by partial charging failure due to pinhole leakage.

[Comparative Example 4]

Image formation and evaluation were performed in the same manner as in Example 1 except that the photosensitive member prepared in Photosensitive member Production Example 3 was used. As a result, from the initial stage, image flow defect occurred due to flow of latent image potential.

[Comparative Example 5]

Image formation and evaluation were performed in the same manner as in Example 7 except that the photosensitive member prepared in Photosensitive member Production Example 3 was used. As a result, from the initial stage, image flow defect occurred due to flow of latent image potential.

[Comparative Example 6]

Image formation and evaluation were performed in the same manner as in Example 13 except that magnetic particles prepared in Magnetic particle Production Example 18 were used. As a result, from the initial stage, poor images occurred (solid white images were accompanied with fog) due to charging failure.

[Comparative Example 7]

Image formation and evaluation were performed in the same manner as in Example 13 except that magnetic particles prepared in Magnetic particle Production Example 19 were used. As a result, from the initial stage, solid white images were accompanied with black spots caused by partial charging failure due to pinhole leakage.

[Comparative Example 8]

Image formation and evaluation were performed in the same manner as in Example 12 except that the photosensitive member prepared in Photosensitive member Production Example 4 was used. As a result, from the initial stage, solid white images were accompanied with fog caused by partial charging failure due to pinhole leakage. Further, from the initial stage, image flow occurred due to flow of a latent potential flow.

What is claimed is:

1. An electrophotographic apparatus comprising:

an electrophotographic photosensitive member and charging means, imagewise exposure means and developing means disposed in this order opposite to the photosensitive member, wherein said photosensitive member comprises a photosensitive layer and a surface layer comprising a charge-injection layer overlying said photosensitive layer, wherein said charge-injection layer is an inorganic layer or a resin layer containing electroconductive particles therein, said charging means includes a charging member comprising magnetic particles and disposed contactable to the photosensitive member and a power source for supplying a voltage to said charging member, wherein said photosensitive member being chargeable to a surface potential of at least 80% of a DC voltage when said DC voltage is supplied from said power source to said charging member through a magnetic brush formed from said magnetic particles, the magnetic particles have a volume resistivity in the range of $1\times10^4$–$1\times10^9$ ohm.cm, and the magnetic particles have a surface layer having a volume resistivity of at most $1\times10^9$ ohm.cm.

2. An apparatus according to claim 1, wherein the charge-injection layer has a volume resistivity of $1\times10^8$–$1\times10^{15}$ ohm.cm.

3. An apparatus according to claim 1 or 2, wherein the charging member has a resistance of $1\times10^4$–$1\times10^9$ ohm.

4. An apparatus according to claim 1 or 2, wherein the magnetic particles comprise a core and a surface layer coating the core.

5. An apparatus according to claim 4, wherein the surface layer comprises electroconductive particles and a binder resin.

6. An apparatus according to claim 5, wherein the surface layer contains lubricating particles.

7. An apparatus according to claim 5, wherein the surface layer has a volume resistivity of $1\times10^4$–$\times10^9$ ohm.cm.

8. An apparatus according to claim 4, wherein the surface layer comprises an inorganic substance different from that of the core and sticking onto the core.

9. An apparatus according to claim 8, wherein the surface layer has a volume resistivity of at most $1\times10^7$ ohm.cm.

10. An apparatus according to claim 8, wherein the surface layer has a volume resistivity which is lower than that of the core.

11. An apparatus according to claim 1 or 2, wherein the charge-injection layer comprises electroconductive particles and a binder resin.

12. An apparatus according to claim 11, wherein the charge-injection layer contains lubricating particles.

13. A process cartridge comprising:

an electrophotographic photosensitive member, and charging means and developing means disposed in this order opposite to the photosensitive member, wherein said photosensitive member comprises a photosensitive layer and a surface layer comprising a charge-injection layer overlying said photosensitive layer, wherein said charge-injection layer is an inorganic layer or a resin layer containing electroconductive particles therein, said charging means includes a charging member comprising magnetic particles and disposed contactable to the photosensitive member and a power source for supplying a voltage to said charging member, wherein said photosensitive member being chargeable to a surface potential of at least 80% of a DC voltage when said DC voltage is supplied from said power source to said charging member through a magnetic brush formed from said magnetic particles, the magnetic particles have a volume resistivity in the range of $1\times10^4$–$1\times10^9$ ohm.cm, the magnetic particles have a surface layer having a volume resistivity of at most $1\times10^9$ ohm.cm, and said electrophotographic photosensitive member, charging means and developing means are integrally supported to form a cartridge which is detachably mountable to an electrophotographic apparatus main body.

14. A process cartridge according to claim 13, wherein the charge-injection layer has a volume resistivity of $1\times10^8$–$1\times10^{15}$ ohm.cm.

15. A process cartridge according to claim 13 or 14, wherein the charging member has a resistance of $1\times10^4$–$1\times10^9$ ohm.

16. A process cartridge according to claim 13 or 14, wherein the magnetic particles comprise a core and a surface layer coating the core.

17. A process cartridge according to claim 16, wherein the surface layer comprises electroconductive particles and a binder resin.

18. A process cartridge according to claim 17, wherein the surface layer contains lubricating particles.

19. A process cartridge according to claim 17, wherein the surface layer has a volume resistivity of $1\times10^4$–$1\times10^9$ ohm.cm.

20. A process cartridge according to claim 16, wherein the surface layer comprises an inorganic substance different from that of the core and sticking onto the core.

21. A process cartridge according to claim 20, wherein the surface layer has a volume resistivity of at most $1\times10^7$ ohm.cm.

22. A process cartridge according to claim 20, wherein the surface layer has a volume resistivity which is lower than that of the core.

23. A process cartridge according to claim 13 or 14, wherein the charge-injection layer comprises electroconductive particles an a binder resin.

24. A process cartridge according to claim 23, wherein the charge-injection layer contains lubricating particles.

25. An image forming method comprising the steps of:

charging an electrophotographic photosensitive member by applying a voltage to a charging member comprising magnetic particles and disposed in contact with the photosensitive member, said photosensitive member being charged to a surface potential of at least 80% of a DC voltage when said DC voltage is supplied from said power source to said charging member through a magnetic brush formed from said magnetic particles, imagewise exposing the charged photosensitive member to form an electrostatic image on the photosensitive member, and developing the electrostatic image, wherein said photosensitive member comprises a photosensitive layer and a surface layer comprising a charge-injection layer overlying said photosensitive layer, wherein said charge-injection layer is an inorganic layer or a resin layer containing electroconductive particles therein, the magnetic particles have a volume resistivity in the range of $1\times10^4$–$1\times10^9$ ohm.cm, and the magnetic particles have a surface layer having a volume resistivity of at most $1\times10^9$ ohm.cm.

26. A method according to claim 25, wherein the charge-injection layer has a volume resistivity of $1\times10^8$–$1\times10^{15}$ ohm.cm.

27. A method according to claim 25 or 26, wherein the charging member has a resistance of $1\times10^4$–$1\times10^9$ ohm.

28. A method according to claim 25 or 26, wherein the magnetic particles comprise a core and a surface layer coating the core.

29. A method according to claim 28, wherein the surface layer comprises electroconductive particles and a binder resin.

30. A method according to claim 29, wherein the surface layer contains lubricating particles.

31. A method according to claim 29, wherein the surface layer has a volume resistivity of $1\times10^4$–$1\times10^9$ ohm.cm.

32. A method according to claim 28, wherein the surface layer comprises an inorganic substance different from that of the core and sticking onto the core.

33. A method according to claim 32, wherein the surface layer has a volume resistivity of at most $1\times10^7$ ohm.cm.

34. A method according to claim 32, wherein the surface layer has a volume resistivity which is lower than that of the core.

35. A method according to claim 25 or 26, wherein the charge-injection layer comprises electroconductive particles an a binder resin.

36. A method according to claim 35, wherein the charge-injectionlayer contains lubricating particles.

* * * * *

UNITED STATES PATENT AND TRADEMARK OFFICE

CERTIFICATE OF CORRECTION

PATENT NO. : 5,890,037

DATED : March 30, 1999

INVENTOR(S) : TSUTOMU KUKIMOTO ET AL.

It is certified that error appears in the above-identified patent and that said Letters Patent is hereby corrected as shown below:

On the title page,

AT [56] REFERENCES CITED

FOREIGN PATENT DOCUMENTS

--03010267" should read --3-010267--.

COLUMN 1

Line 21, "steps." should read --step.--.
Line 44, "the" should read --its--.

COLUMN 2

Line 18, "noise"" should read --noise")--.

COLUMN 5

Line 8, "valves" should read --values--.

COLUMN 6

Line 12, "actylate," should read --acrylate,--.
Line 17, "include;" should read --include:--.
Line 39, "SA4," should read --SA-4,--.

UNITED STATES PATENT AND TRADEMARK OFFICE

CERTIFICATE OF CORRECTION

PATENT NO. : 5,890,037

DATED : March 30, 1999

INVENTOR(S) : TSUTOMU KUKIMOTO ET AL.

It is certified that error appears in the above-identified patent and that said Letters Patent is hereby corrected as shown below:

COLUMN 8

Line 21, "change" should read --charge--.
Line 57, "containing." should read --coating.--.

COLUMN 9

Line 18, "break-" should read --leak--.
Line 50, "then" should read --their--.
Line 61, "vinylcarbozole" should read --vinylcarbazole--; and "polyvinylanthracene." should read --polyvinyl-anthracene.--

COLUMN 10

Line 53, "extruded" should read --extruder--.

COLUMN 12

Line 29, "electronmicroscope)" should read --electron microscope)--.

COLUMN 15

Line 3, "descried" should read --described--.

UNITED STATES PATENT AND TRADEMARK OFFICE

CERTIFICATE OF CORRECTION

PATENT NO. : 5,890,037

DATED : March 30, 1999

INVENTOR(S) : TSUTOMU KUKIMOTO ET AL.

It is certified that error appears in the above-identified patent and that said Letters Patent is hereby corrected as shown below:

COLUMN 16

Line 42, "means 2" should read --means--.
Line 44, "attached-to" should read --attached to--.
Line 47, "understand" should read --understood--.
Line 49, "a" should be deleted.

COLUMN 17

Line 12, "sold" should read --solid--.

COLUMN 18

Line 25, "photosensitive" should read --Photosensitive--.

COLUMN 19

Line 3, "the the" should read --the--.
Line 6, "sped" should read --speed--.
Line 18, "Nagnetic" should read --Magnetic--.
Line 59, "volt." should read --volts.--.

UNITED STATES PATENT AND TRADEMARK OFFICE

CERTIFICATE OF CORRECTION

PATENT NO. : 5,890,037

DATED : March 30, 1999

INVENTOR(S) : TSUTOMU KUKIMOTO ET AL.

It is certified that error appears in the above-identified patent and that said Letters Patent is hereby corrected as shown below:

COLUMN 21

Line 18, "$1x10^4$-$x10^9$ ohm.cm." should read --$1x10^4$-$1x10^9$ ohm.cm.--.

COLUMN 22

Line 19, "an" should read --and--.

COLUMN 23

Line 5, "injectionlayer" should read --injection layer--.

Signed and Sealed this

Fourth Day of January, 2000

*Attest:*

*Attesting Officer*

*Acting Commissioner of Patents and Trademarks*